US006098691A

United States Patent [19]

Boldrini

[11] Patent Number: 6,098,691

[45] Date of Patent: Aug. 8, 2000

[54] GUMMING DEVICE FOR APPLYING ADHESIVE TO SHEET MATERIAL

[75] Inventor: Fulvio Boldrini, Ferrara, Italy

[73] Assignee: G D Societa Azioni, Bologna, Italy

[21] Appl. No.: 08/982,775

[22] Filed: Dec. 2, 1997

[30] Foreign Application Priority Data

Dec. 4, 1996 [IT] Italy ..... B096A0627

[51] Int. Cl.[7] ..... B05C 1/06; B65C 11/04

[52] U.S. Cl. ..... 156/578; 118/261

[58] Field of Search ..... 118/261; 156/578

[56] References Cited

U.S. PATENT DOCUMENTS

| | | | |
|---|---|---|---|
| 2,467,998 | 4/1949 | Stefanelli | 118/261 X |
| 2,596,585 | 5/1952 | Minkow | 118/261 |
| 2,787,244 | 4/1957 | Hickin . | |
| 2,797,661 | 7/1957 | Leaming | 118/261 X |
| 3,711,888 | 1/1973 | Dunlap | 118/261 X |
| 3,722,465 | 3/1973 | Krautzberger | 118/261 X |
| 4,167,916 | 9/1979 | Pierce . | |
| 4,344,379 | 8/1982 | Roberts | 118/261 X |
| 5,168,806 | 12/1992 | Reder et al. | 118/261 X |
| 5,330,575 | 7/1994 | Poole et al. | 118/261 X |
| 5,352,322 | 10/1994 | Leverick | 118/261 X |
| 5,633,045 | 5/1997 | Smith et al. | 118/261 X |
| 5,826,296 | 10/1998 | Steven | 118/261 X |

FOREIGN PATENT DOCUMENTS

| | | |
|---|---|---|
| 2602484 | 2/1988 | France . |
| 2 195 925 | 4/1988 | United Kingdom . |

*Primary Examiner*—Curtis Mayes
*Attorney, Agent, or Firm*—Klauber & Jackson

[57] ABSTRACT

A gumming device for applying adhesive to sheet material fed between a rotary pressure member and a rotary gumming member substantially tangent to the pressure member and having peripheral projections with cavities for retaining and applying the adhesive to predetermined portions of the sheet material; scraping devices for removing surplus adhesive from the gumming member being provided upstream from the point at which the adhesive is applied, and being maintained continuously contacting the gumming member by the respective contacting surfaces of the gumming member and the scraping devices interacting substantially elastically with each other.

3 Claims, 2 Drawing Sheets

GUMMING DEVICE FOR APPLYING ADHESIVE TO SHEET MATERIAL

BACKGROUND OF THE INVENTION

The present invention relates to a gumming device for applying adhesive to sheet material.

More specifically, the present invention relates to a gumming device for applying adhesive to cardboard blanks on a packing machine.

Gumming devices are known, which comprise a vessel containing adhesive; and a rotary, substantially roller-shaped gumming member for withdrawing part of the adhesive in which it is partly immersed, and the peripheral surface of which comprises projections with cavities for retaining and applying part of the adhesive to predetermined parts of the blanks.

Such gumming devices also comprise scraping devices for removing surplus adhesive from the peripheral surfaces of the projections outside the cavities, and which are located, with respect to the traveling direction of the blanks, upstream from where the adhesive is applied to the blanks; and a rotary, substantially cylindrical pressure member tangent to, and for pressing the blanks against, the gumming member.

Such gumming devices may also comprise a rotary, substantially cylindrical transfer member for withdrawing and transferring part of the adhesive from the vessel to the gumming member, and which is interposed between the adhesive, in which it is partly immersed, and the gumming member to which it is substantially tangent.

The scraping devices of gumming devices of the above type are fixed and so shaped as to skim the peripheral surfaces of the projections as the gumming member rotates, to remove surplus adhesive from the peripheral surfaces outside the cavities. Scraping devices of this sort, however, fail to prevent a certain amount of adhesive from accumulating, during operation, in portions of the gumming member extending between adjacent projections, on account of the distance between these portions and the scraping devices. As a result, the packing machine must be stopped frequently to clean the peripheral surface of the gumming member and prevent the gumming member from also depositing traces of adhesive on other than said predetermined parts of the blanks.

To eliminate the above drawback, a gumming device of the above type has been proposed featuring movable scraping devices controlled by cam members so as to follow the whole contour, i.e. the whole peripheral surface, of the gumming member as it rotates. Such a device, however, fails to provide for fully eliminating the drawback, owing to the difficulty encountered in maintaining substantial contact between the movable scraping devices and the contour of the gumming member at modern packing machine speeds.

SUMMARY OF THE INVENTION

It is an object of the present invention to provide a gumming device designed to eliminate the aforementioned drawbacks.

According to the present invention, there is provided a gumming device for applying adhesive to sheet material, in particular cardboard blanks fed successively on a packing machine, and comprising a vessel containing adhesive; a rotary, substantially roller-shaped gumming member for withdrawing part of said adhesive, and the peripheral surface of which comprises a number of projections having cavities for retaining and applying part of said adhesive to predetermined portions of each of said blanks at a gumming location; a rotary pressure member substantially tangent to said gumming member at said gumming location; and scraping means in turn comprising a scraping member having an edge for removing surplus adhesive from said peripheral surface of said gumming member; characterized in that said scraping means comprise elastic means for keeping said edge continuously contacting said peripheral surface as said gumming member rotates.

According to a first preferred embodiment of the above gumming device, said elastic means comprise a flexible blade defining said scraping member.

According to a further preferred embodiment of the above gumming device, said elastic means comprise spring means engaging said scraping member.

BRIEF DESCRIPTION OF THE DRAWINGS

The present invention will now be described by way of a non-limiting example with reference to the accompanying drawings, in which.

DETAILED DESCRIPTION OF THE INVENTION

Figure 1:
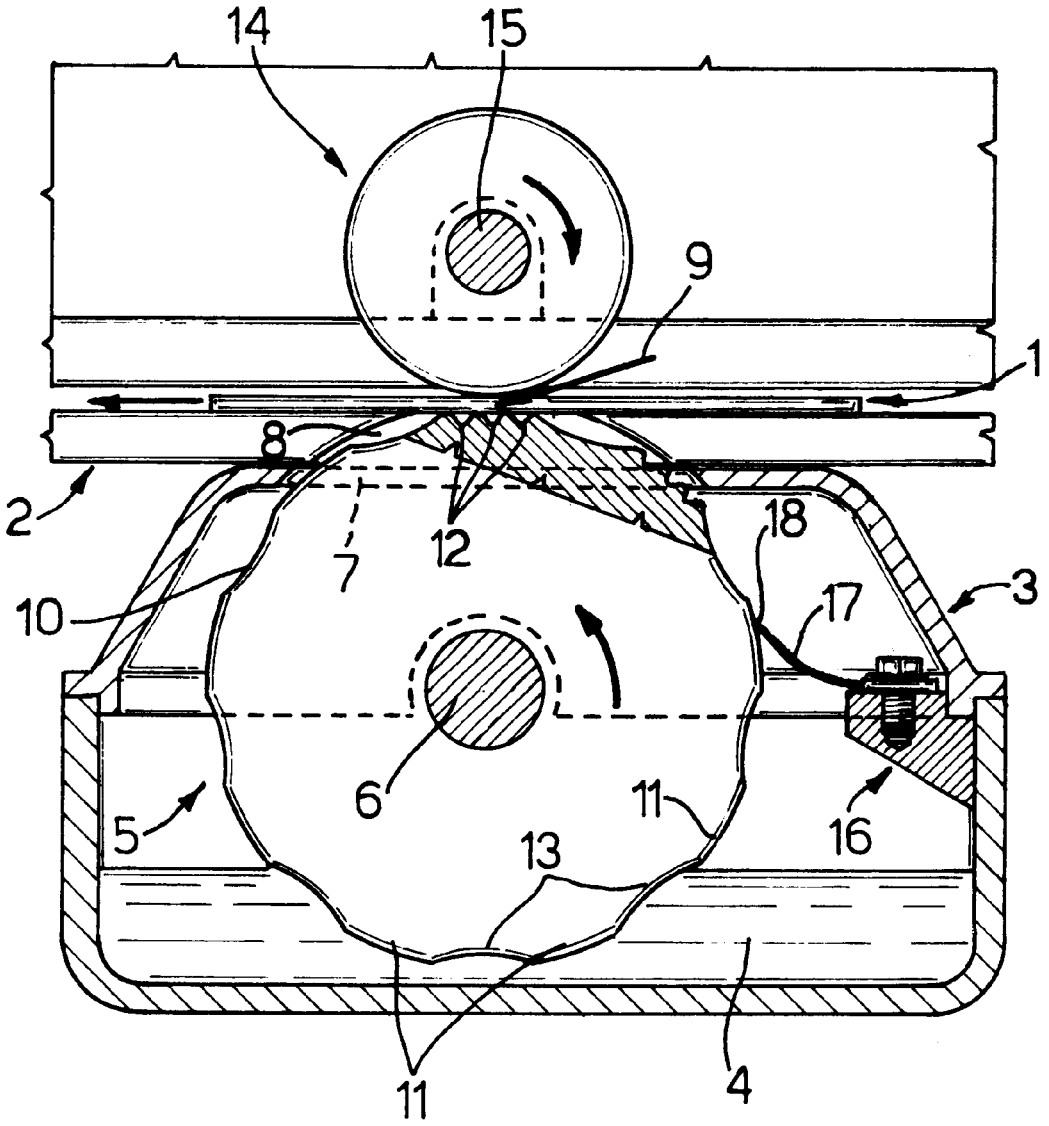
FIG. 1 shows a section of the gumming device according to the present invention.
Figure 2:
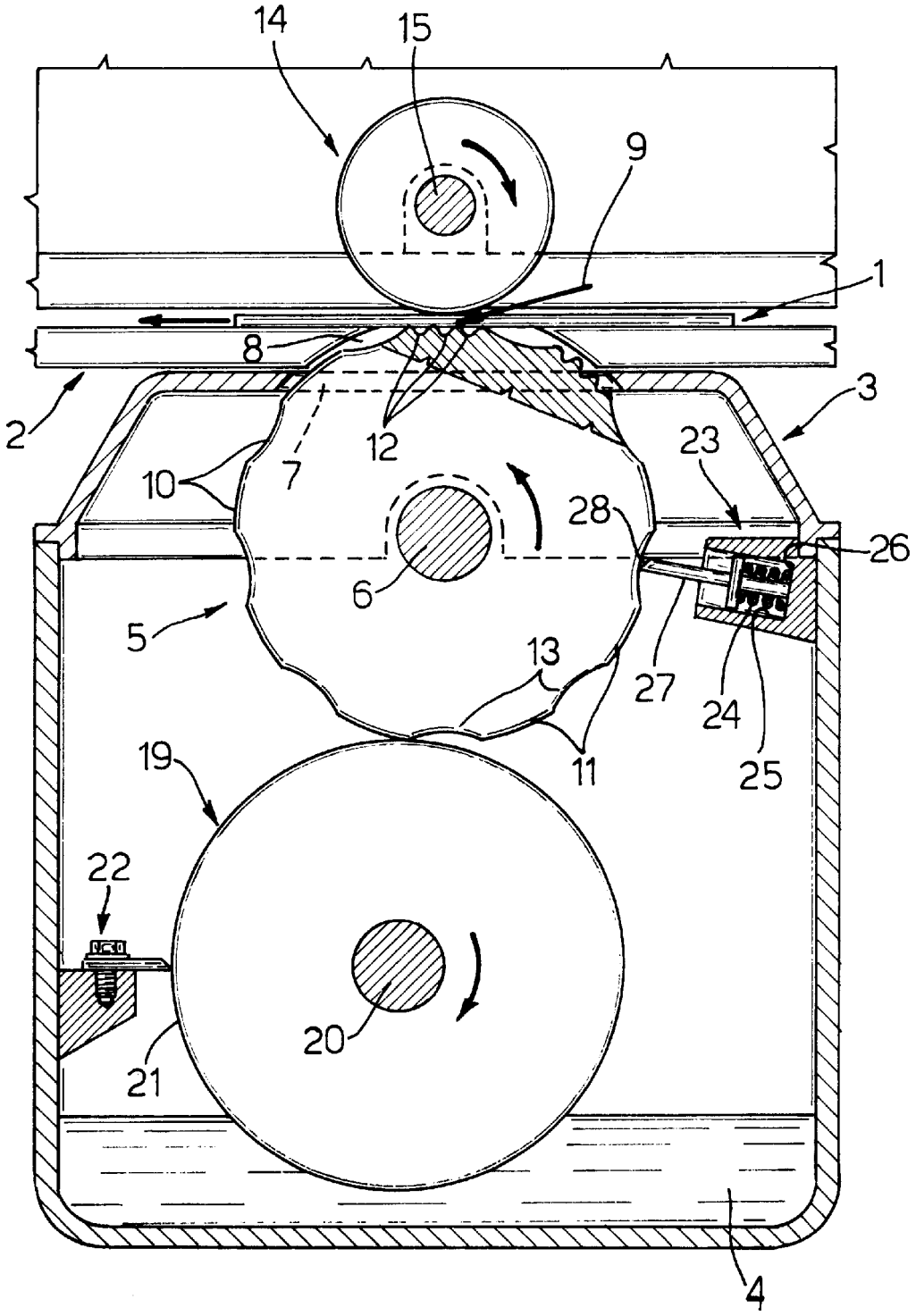
FIG. 2 shows a section of a different version of the gumming device according to the present invention.

Number 1 in FIGS. 1 and 2 indicates, as a particular sheet material, a cardboard blank, e.g. of the type for packing an orderly group of cigarettes.

Number 2 indicates a bed along which blanks 1 are fed, and which is located over a vessel 3 containing adhesive 4.

Vessel 3 partly houses a rotary gumming member 5, which is supported and rotated anticlockwise (in FIGS. 1 and 2) by a shaft 6 connected to a motor (not shown) of the packing machine (not shown) of which the gumming device forms part. Part of gumming member 5 projects through an opening 7 formed in vessel 3 at a gap 8 formed in bed 2 and permitting tangential contact between gumming member 5 and blank 1 at a gumming location indicated by arrow 9. Gumming member 5 withdraws part of adhesive 4, and comprises, on its peripheral surface 10, a number of projections 11 in turn comprising cavities 12 and connected to one another by rounded depressed portions 13.

A rotary pressure member 14, substantially tangent to gumming member 5 at gumming location 9, is supported and rotated clockwise (in FIGS. 1 and 2) by a shaft 15 connected to a motor (not shown) of the packing machine of which the gumming device forms part.

With reference to FIG. 1, scraping means 16 are connected rigidly to a lateral wall of vessel 3 upstream from gumming location 9 with respect to the rotation direction of gumming member 5, and comprise elastic means defined by a flexible blade 17 defining a scraping member with a sharp free edge 18. Flexible blade 17 is so sized as to ensure continuous contact between edge 18 and surface 10 as gumming member 5 rotates.

With reference to FIG. 2, number 19 indicates a rotary transfer member supported and rotated clockwise (in FIG. 2) by a shaft 20 connected to a motor (not shown) of the packing machine of which the gumming device forms part. Transfer member 19 withdraws part of adhesive 4, in which it is partly immersed, and, by means of its peripheral surface 21, transfers the adhesive to peripheral surface 10 of gumming member 5 substantially tangent to peripheral surface 21.

The thickness of adhesive 4 on peripheral surface 21 of transfer member 19 is limited by fixed scraping devices 22 connected rigidly to a lateral wall of vessel 3 upstream, with respect to the rotation direction of transfer member 19, from the point of substantial tangency between transfer member 19 and gumming member 5.

Again with reference to FIG. 2, scraping means 23 are rigidly connected to a lateral wall of vessel 3 downstream, with respect to the rotation direction of gumming member 5, from the point of substantial tangency between transfer member 19 and gumming member 5, and upstream from gumming location 9. Scraping means 23 comprise elastic means defined by spring means 24 housed inside a cavity 25 and interposed between the bottom 26 of cavity 25 and a scraping member 27 comprising a sharp edge 28; scraping member 27 is in turn interposed between spring means 24 and peripheral surface 10 of gumming member 5; and spring means 24 engaging scraping member 27 are so sized as to ensure continuous contact between sharp edge 28 and peripheral surface 10 as gumming member 5 rotates.

In actual use, and with reference to both FIGS. 1 and 2, blanks 1 are fed successively by conveying means (not shown) onto bed 2 of the gumming device, and, as the blanks are fed between gumming member 5 and pressure member 14, traces of adhesive 4 are applied by cavities 12 of projections 11 onto predetermined parts of the blanks at gumming location 9.

The surplus adhesive 4 withdrawn by gumming member 5 is removed continuously by scraping means 16, 23, which act both on the peripheral surfaces of projections 11 and on rounded depressed portions 13 so that a given amount of adhesive 4 is only left inside cavities 12.

The gumming devices according to the present invention therefore clearly provide for eliminating the drawbacks described in connection with known gumming devices featuring gumming members with projections.

That is, by maintaining continuous contact between gumming member and scraping means, by the respective acting surfaces interacting substantially elastically, and by eliminating any sharp edges on the peripheral surface of the gumming member, the entire peripheral surface of the gumming member outside the grooves is cleaned continuously to prevent adhesive from accumulating in the depressed portions between adjacent projections, and so avoid frequent stoppage of the packing machine to clean the gumming member.

What is claimed is:

1. A gumming device for applying adhesive to sheet material, in particular cardboard blanks fed successively on a packing machine, comprising a vessel containing adhesive; a rotary, substantially roller shaped gumming member for withdrawing part of said adhesive, and the peripheral surface of which comprises a number of projections having cavities for retaining an applying part of said adhesive to predetermined portions of each said blank at a gumming location; a rotary pressure member substantially tangent to said gumming member at said gumming location; and scraping means in turn comprising a scraping member having a free sharp edge for removing surplus adhesive from said peripheral surface of said gumming member; said scraping means including a flexible blade for keeping said edge continuously contacting said peripheral surface as said gumming member rotates;

wherein said flexible blade alternates between a flexed state when contacting said projections and a generally non-flexed state;

wherein said flexible blade when in a non-flexed state lies in a plane that extends through the diameter of said roller shaped gumming member.

2. The gumming device according to claim 1 wherein said flexible blade is sized so as to ensure said edge continuously contacts said peripheral surface.

3. The gumming device according to claim 1 wherein said flexible blade is arranged in spaced apart relation to said peripheral surface to ensure said edge continuously contacts said peripheral surface.

* * * * *

UNITED STATES PATENT AND TRADEMARK OFFICE

CERTIFICATE OF CORRECTION

PATENT NO. : 6,098,691
DATED : August 8, 2000
INVENTOR(S) : Fulvio Boldrini

It is certified that error appears in the above-identified patent and that said Letters Patent is hereby corrected as shown below:

Title page,
The Assignee's name should read as follows: Item [73], -- G.D Societa' Per Azioni --

Signed and Sealed this

Thirteenth Day of November, 2001

*Attest:*

Nicholas P. Godici

*Attesting Officer*

NICHOLAS P. GODICI
*Acting Director of the United States Patent and Trademark Office*